US009345923B2

(12) United States Patent
Haggard et al.

(10) Patent No.: US 9,345,923 B2
(45) Date of Patent: May 24, 2016

(54) WEIGHT TRAINING APPARATUS AND METHOD OF USING

(71) Applicants: Adam Haggard, Huntertown, IN (US); R. Shane Burge, Fort Wayne, IN (US)

(72) Inventors: Adam Haggard, Huntertown, IN (US); R. Shane Burge, Fort Wayne, IN (US)

( * ) Notice: Subject to any disclaimer, the term of this patent is extended or adjusted under 35 U.S.C. 154(b) by 0 days.

(21) Appl. No.: 14/459,666

(22) Filed: Aug. 14, 2014

(65) Prior Publication Data

US 2016/0045777 A1 Feb. 18, 2016

(51) Int. Cl.
*A63B 21/078* (2006.01)
*A63B 23/04* (2006.01)

(52) U.S. Cl.
CPC ..... *A63B 21/078* (2013.01); *A63B 2023/0411* (2013.01)

(58) Field of Classification Search
CPC .. A63B 21/06; A63B 21/0615; A63B 21/078; A63B 21/072; A63B 21/0724; A63B 2023/0411; A63B 2021/0616; A63B 2021/0617; A63B 2021/0783; A63B 2021/0786; A63B 2208/0223
USPC ..... 482/93–108
See application file for complete search history.

(56) References Cited

U.S. PATENT DOCUMENTS

| | | | | |
|---|---|---|---|---|
| 4,799,672 | A * | 1/1989 | Barrett | A63B 21/078 482/104 |
| 5,116,297 | A * | 5/1992 | Stonecipher | A63B 21/0615 482/137 |
| 6,770,017 | B1 * | 8/2004 | Leipheimer | A63B 21/0615 482/100 |
| 7,025,712 | B2 * | 4/2006 | Parrilla | A63B 21/072 482/104 |
| 2004/0242383 | A1 * | 12/2004 | Karlstrom | A63B 21/0083 482/93 |
| 2007/0155595 | A1 * | 7/2007 | Rogers | A63B 21/0615 482/94 |
| 2012/0225756 | A1 * | 9/2012 | Reyes | A63B 21/1457 482/104 |
| 2012/0329614 | A1 * | 12/2012 | Schiano | A63B 21/078 482/104 |
| 2013/0296143 | A1 * | 11/2013 | Staten | A63B 21/0618 482/98 |
| 2014/0296040 | A1 * | 10/2014 | Mobley | A63B 21/078 482/104 |
| 2015/0224358 | A1 * | 8/2015 | Chen | F16M 13/027 248/327 |

* cited by examiner

*Primary Examiner* — Oren Ginsberg
*Assistant Examiner* — Gregory Winter
(74) *Attorney, Agent, or Firm* — Jacque R. Wilson; Carson Boxberger LLP

(57) ABSTRACT

A weightlifting weight support assembly includes a weight rack with a pair of vertical upright beams. Each of the vertical upright beams includes a plurality of bores disposed vertically along the front of the beams. The assembly further includes an elongated cross member and a lever arm selectively rotatably attached to at least one of the ends of the elongated cross member. There is also provided a first and second cross member support subassembly.

1 Claim, 7 Drawing Sheets

WEIGHT TRAINING APPARATUS AND METHOD OF USING

BACKGROUND

1. Field of the Art

The present invention relates to weightlifting equipment, and more particularly to a support hook assembly for resting a weight bar.

2. Description of the Prior Art

Weightlifters perform various exercises for the purpose of developing particular muscles throughout the body. These exercises can be performed through the use of free weights, such as barbells, or with machines. Many weightlifters prefer free weights because free weights permit the lifter to perform the exercises in a natural motion while utilizing pure body leverage in performing the exercise. This facilitates isolation of particular muscle groups and simulates actual athletic sports motions. The support assembly also often operates to spot the lifter and prevent the free weight from being dropped past a particular point.

Between "sets" free weights are rested upon a support assembly which mounts to a weight bar frame rack. The support assembly is also adjustable relative to the frame rack to locate the weight at a height desired for a particular lifter. Conventional support assemblies are typically posts or hooks which engage the frame rack at one of a multitude of locations.

Athletic trainers throughout the country have begun to realize the critical role strength training plays with regard to their athlete's goals of overall physical fitness. A problem arises when gyms have limited funding, space, or both. For example, squatting is considered one of the best methods for gaining strength. However, squatting heavier weights can cause notable strain and even injury on knees, hips and lower back. Maneuvering 500 pounds off a rig and back several steps to be able to safely drop into a squat position can be awkward and dangerous. A much safer option is to simply remove the hooks holding the bar and drop straight into the squat position, rise and reengage the hooks.

Prior art solutions to this problem include "monolift" weight training devices. While functional, prior art devices are large, stand-alone structures that usually operate hydraulically. Unfortunately, many gyms cannot afford the expense of such machines or have to sacrifice floor space to pair a prior art monolift with the weight training/pull-up rig that is already present on the gym floor.

Thus, a need exists for a weight support assembly that supports a significant amount of weight, and can be easily retrofit to be securely lockable to an existing weight training/pull-up rig.

SUMMARY

The present invention attaches to an existing pull-up rig for the purpose of safely squatting heavy weight without putting undue stress on the athlete's body. For example, the present invention can be attached to an existing weight training rig with a pull-up bar just beneath the existing pull-up bar. The present invention incorporates a cross member to hang two supporting arms just inside the rig's uprights. The arms have adjustable J-hooks which support the barbell. Once an athlete is in position, a spotter uses a lever arm off to the side of the rig to pull the supporting arms, and corresponding J-hooks out of the way. The athlete performs their squat(s), the spotter puts the arms back in place, by releasing the lever arm, and the barbell is returned to its original position.

The present invention generally provides a weightlifting weight support assembly. The assembly comprises a weight rack having a pair of vertical upright beams with bores disposed vertically along the front of said beams. The assembly of the present invention further comprises an elongated cross member with a lever arm selectively rotatably attached to one end and a pair of vertical weight supports fixedly attached along said cross member. Each of the weight supports comprise a plurality of bores to which weight bar receivers are attached. The assembly further comprises first and a second cross member support subassemblies having cross member receiving channels and selectively attached to the front of the weight rack beams.

BRIEF DESCRIPTION OF THE DRAWINGS

The present invention will be understood more fully from the detailed description given hereinafter and from the accompanying drawings of the preferred embodiment of the present invention, which, however, should not be taken to limit the invention, but are for explanation and understanding only. In the drawings.

DETAILED DESCRIPTION OF THE EMBODIMENTS

The present invention will be discussed hereinafter in detail in terms of the preferred embodiment according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order to avoid unnecessary obscuring of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations.

All of the implementations described below are exemplary implementations provided to enable persons skilled in the art to make or use the embodiments of the disclosure and are not intended to limit the scope of the disclosure, which is defined by the claims. In the present description, the terms "upper", "lower", "left", "rear", "right", "front", "vertical", "horizontal", and derivatives thereof shall relate to the invention as oriented in FIG. 1.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
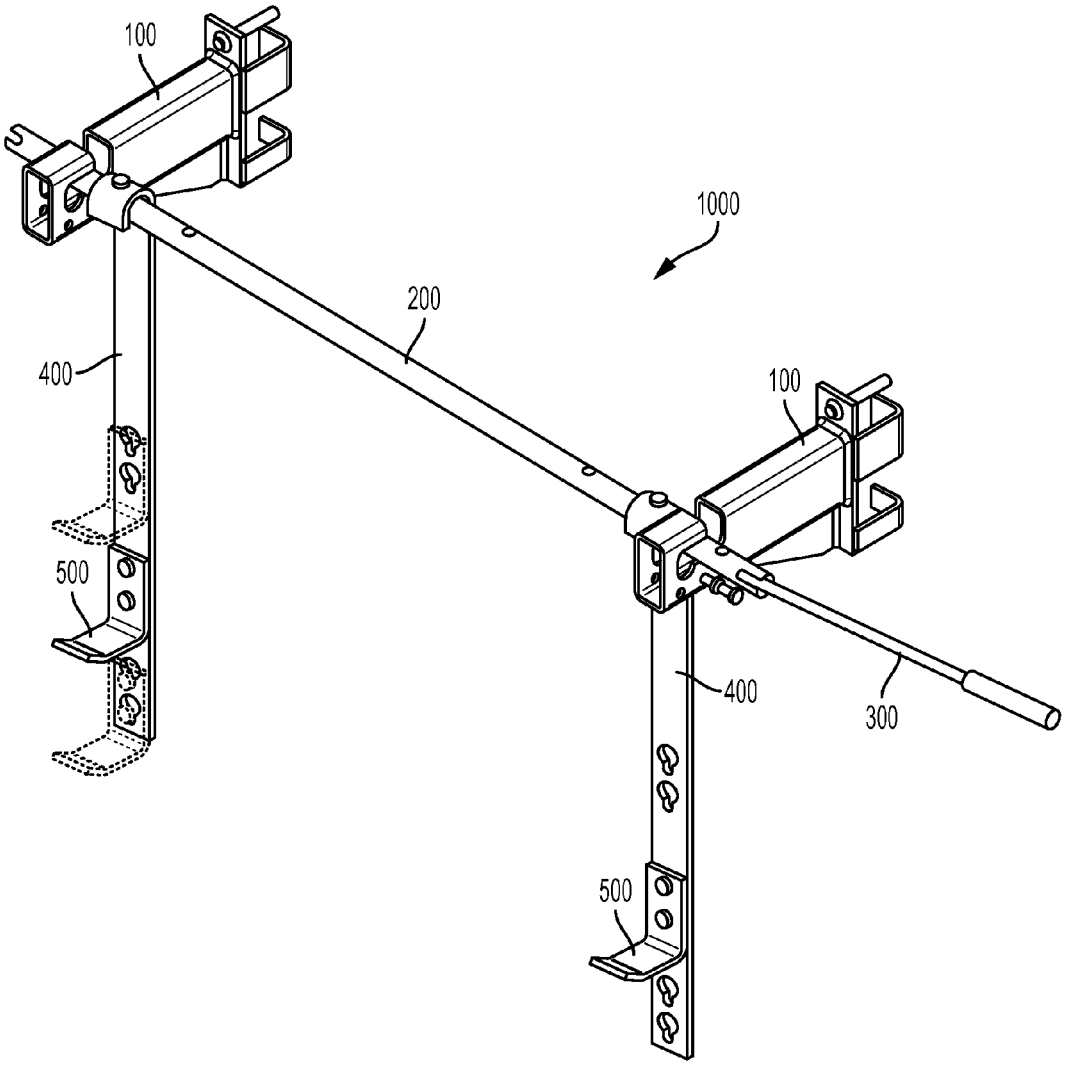
FIG. 1 shows a front perspective view of an exemplary embodiment of a weight lifting weight support assembly according to the present invention.

Referring first to FIG. 1, there is shown front perspective view of an exemplary embodiment of weight lifting weight support assembly 1000 according to the present invention. As shown in FIG. 1, weight support assembly 1000 of the present invention generally comprises a pair of cross member supports 100, cross member 200, cross member lever arm 300, support arms 400, weight bar holding "J hooks" 500.

Figure 2:
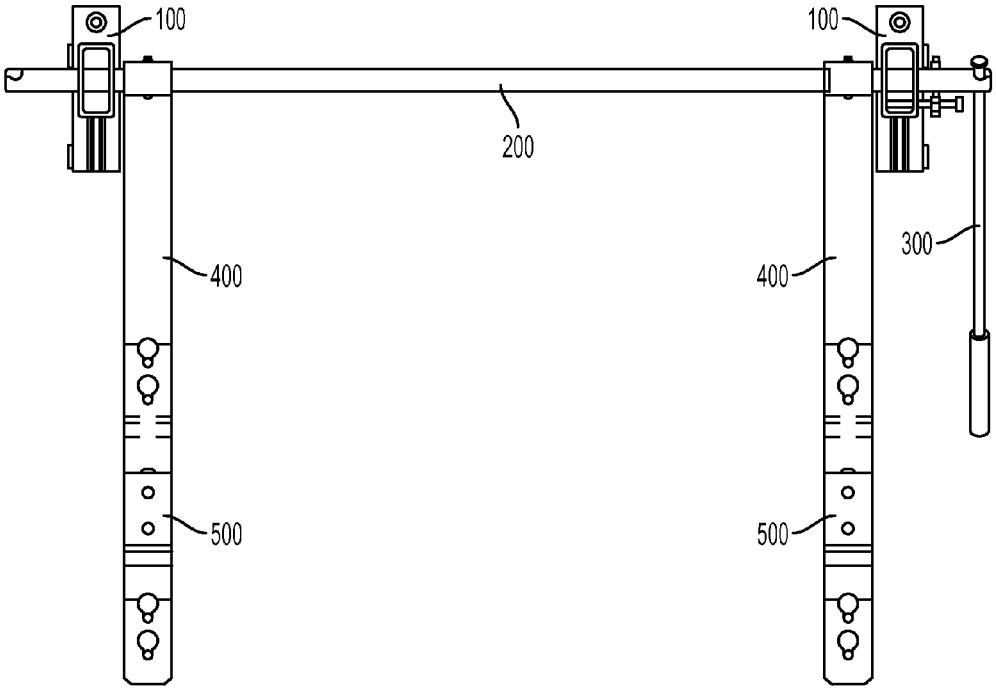
FIG. 2 shows a front view of an exemplary embodiment of a weight lifting weight support assembly according to the present invention.

As further illustrated in FIG. 1, cross member supports 100 are removably attached to a standard pull-up rig of the type commonly seen in gyms or CrossFit locations. Cross member 200 is a generally cylindrical (preferably metal) bar that is removably and rotatably attached to cross member supports 100. Lever arm 300 is selectively rotatably attached to one end of cross member 200. As illustrated in FIG. 1 and FIG. 2, lever arm 300 may be horizontally or vertically oriented relative to apparatus 1000.

Referring next to FIG. 2, there is shown a front view of an exemplary embodiment of weight lifting weight support assembly 1000 according to the present invention. As shown in FIG. 2, weight support assembly 1000 of the present invention generally comprises a pair of cross member supports 100, cross member 200, cross member lever arm 300, support arms 400, weight bar holding "J hooks" 500.

As further illustrated in FIG. 2, cross member supports 100 are removably attached to a standard pull-up rig of the type commonly seen in gyms or CrossFit locations. Cross member 200 is a generally cylindrical (preferably metal) bar that is removably and rotatably attached to cross member supports 100.

Lever arm 300 is selectively rotatably attached to one end of cross member 200. When statically engaged, as shown in FIG. 2, to cross member 200, lever arm 300 is used to rotate cross member 200 about its longitudinal axis. Support arms 400 are fixedly attached to cross member 200. Support arms 400 comprise means for selectively receiving hooks 500 for holding a weight bar. As is apparent from FIGS. 1-3, support arms 400 rotate about the longitudinal axis of cross member 200 when lever arm 300 is used to rotate cross member 200.

Figure 3:
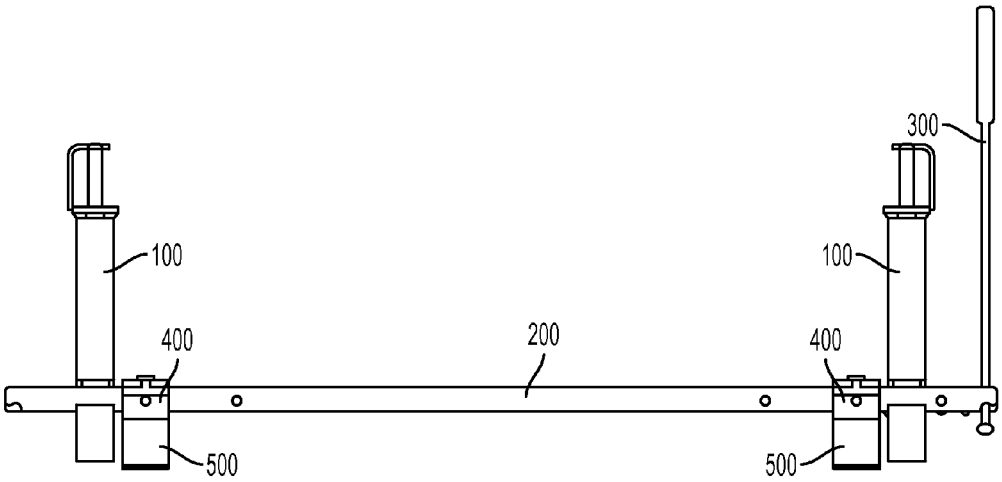
FIG. 3 shows a top view of an exemplary embodiment of a weight lifting weight support assembly according to the present invention.

FIG. 3 shows a top view of an exemplary embodiment of a weight lifting weight support assembly according to the present invention. As shown again in FIG. 3, weight support assembly 1000 of the present invention generally comprises a pair of cross member supports 100, cross member 200, cross member lever arm 300, support arms 400, weight bar holding "J hooks" 500.

Figure 4:
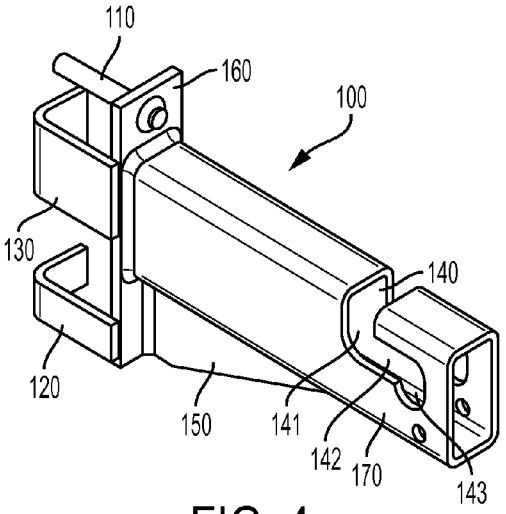
FIG. 4 shows a front perspective view of an exemplary embodiment of a cross member support subassembly according to the present invention.
Figure 6:
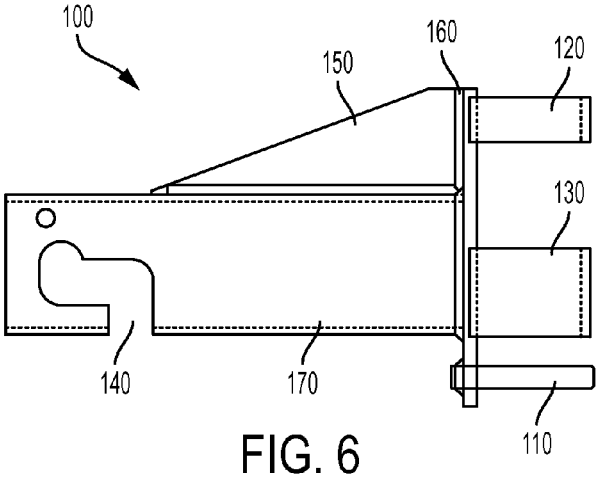
FIG. 6 shows a side view of an exemplary embodiment of a cross member support subassembly according to the present invention.

FIG. 4 shows a front perspective view of an exemplary embodiment of cross member support 100 according to the present invention. As shown in FIG. 4, cross member support 100 comprises a base plate 160 to which is attached a generally elongated cuboid shaped extending member 170 having a recessed groove 140 for receiving cross member 200. As shown in FIG. 4 and in FIG. 6, groove 140 generally comprises a vertical opening 147 a horizontal slot 142, and a vertical trough 143. Preferably, cross member support 100 is made of a steel or other common metal for gym equipment. Support 100 may be cast or welded together. Cross member support 100 further comprises a truss 150 disposed between base 160 and extending member 170 of cross member support 100.

Figure 5:
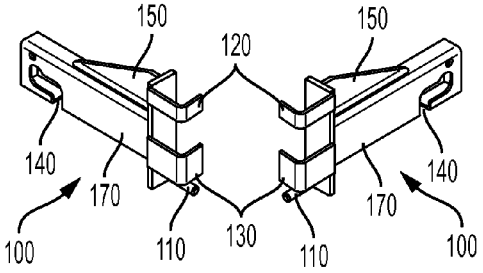
FIG. 5 shows a pair of rear perspective views of an exemplary embodiment of a cross member support subassembly according to the present invention.
Figure 7:
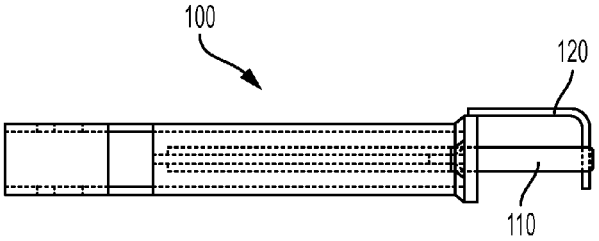
FIG. 7 shows a top view of an exemplary embodiment of a cross member support subassembly according to the present invention.
Figure 8:
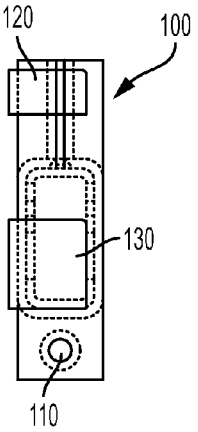
FIG. 8 shows a front view of an exemplary embodiment of a cross member support subassembly according to the present invention.

As further illustrated in FIG. 4, plate 160 is generally shaped like an extruded rectangle having a first side and a second side. Truss 150 and extending member 170 are attached to plate 160 on said first side of plate 160. Various connecting pieces 110, 120, and 130 are attached to the second side of plate 160 to attach cross member supports 100 to a weight training rig or the like. In the exemplary embodiment shown in FIG. 4, FIG. 5 (which shows a pair of rear perspective views of cross member support 100), and FIG. 6 (which shows a side view of an cross member support 100), the various connecting pieces include dowel pin 110 and "L" hooks 120 and 130, which are adapted to cooperatively releasably engage commonly known gym weight training racks. FIGS. 7 and 8 further illustrate top and front views respectively of cross member support 100.

Figure 9:
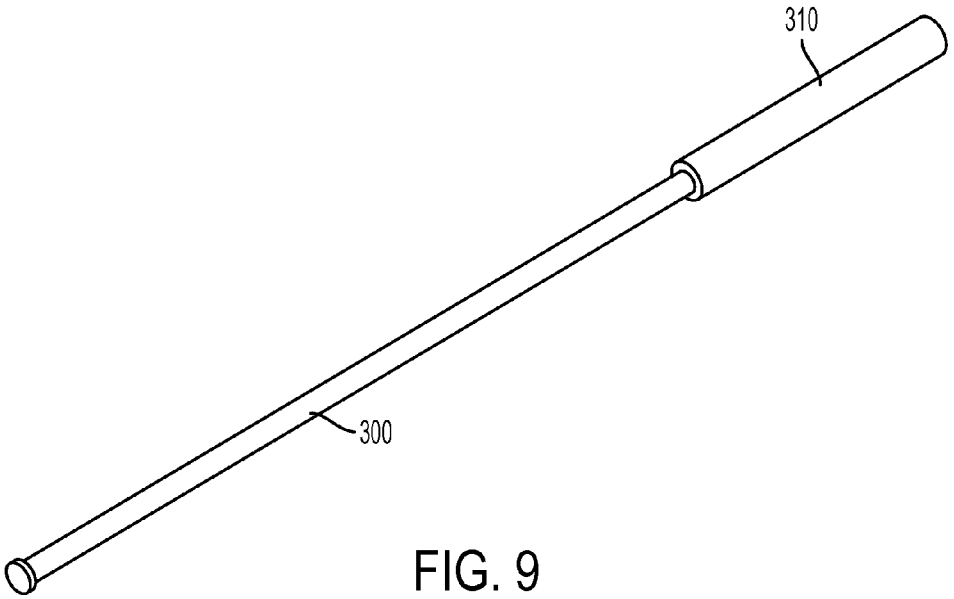
FIG. 9 shows a front perspective view of an exemplary embodiment of a cross member lever arm according to the present invention.
Figure 10:
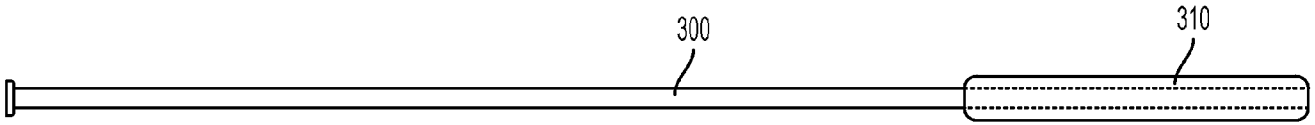
FIG. 10 shows a side view of an exemplary embodiment of a cross member lever arm according to the present invention.

FIG. 9 and FIG. 10 show front perspective and side views, respectively, of an exemplary embodiment of cross member lever arm 300 according to the present invention. As illustrated in FIGS. 9 and 10, lever arm 300 comprises a generally elongated cylindrical steel rod preferably further comprising a handle 310. As first shown in FIG. 1, lever arm 300 is selectively rotatably or statically attached to cross member 200 of apparatus 1000 of the present invention.

Figure 11:
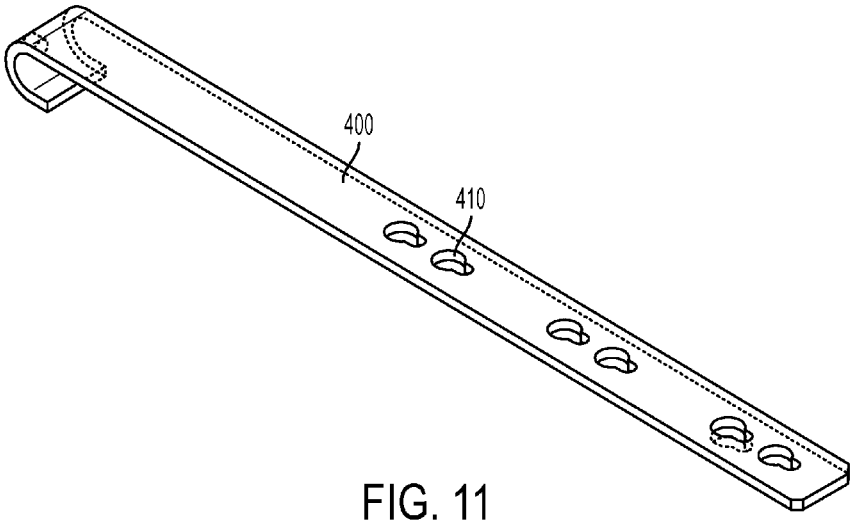
FIG. 11 shows a top perspective view of an exemplary embodiment of a vertical weight support according to the present invention.

Referring next to FIG. 11, there is shown a top perspective view of vertical weight support 400 according to the present invention. As illustrated in FIG. 11, weight support 400 generally comprises a mostly flat elongated cuboid shape with one curved end. Weight support 400 is preferably constructed from steel and may be machined, casted, or otherwise formed into the desired shape. Weight support 400 further comprises a plurality of key holes 410 having a generally circular base and elongated slot which form "tear drop" shaped key holes.

Figure 12:
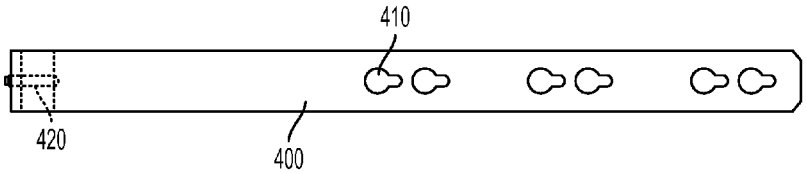
FIG. 12 shows a top view of an exemplary embodiment of a vertical weight support according to the present invention.
Figure 12A:
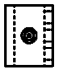
FIG. 12*a* shows a front view of an exemplary embodiment of a vertical weight support according to the present invention.
Figure 13:
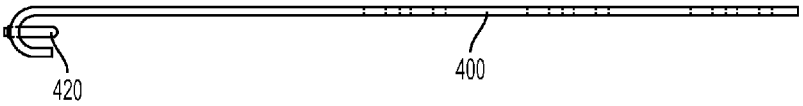
FIG. 13 shows a side view of an exemplary embodiment of a vertical weight support according to the present invention.
Figure 14:
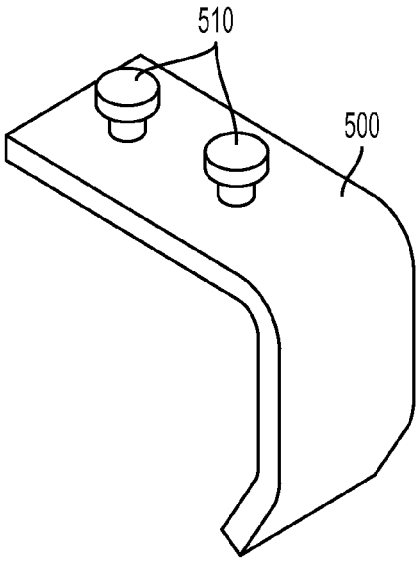
FIG. 14 shows a rear perspective view of an exemplary embodiment of a weight bar hook according to the present invention.
Figure 15:
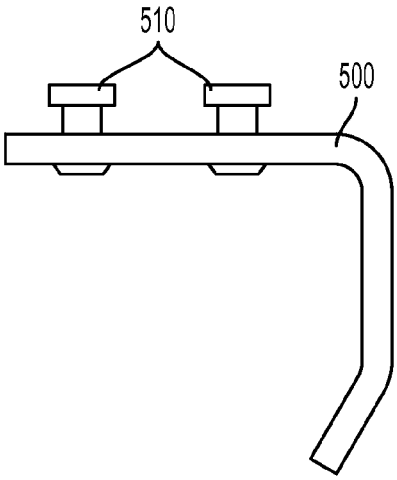
FIG. 15 shows a side view of an exemplary embodiment of a weight bar hook according to the present invention.
Figure 16:
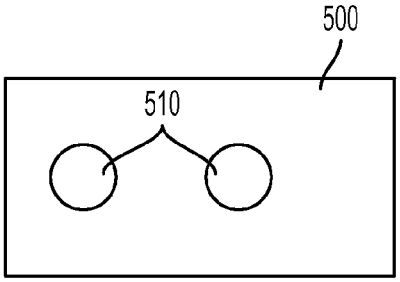
FIG. 16 shows a top view of an exemplary embodiment of a weight bar hook according to the present invention.
Figure 17:
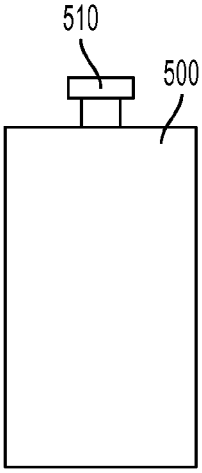
FIG. 17 shows a rear view of an exemplary embodiment of a weight bar hook according to the present invention.
Figure 18:
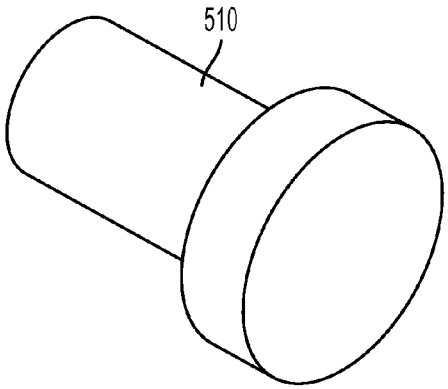
FIG. 18 shows a perspective view of an exemplary embodiment of a weight bar hook pin according to the present invention.
Figure 19:
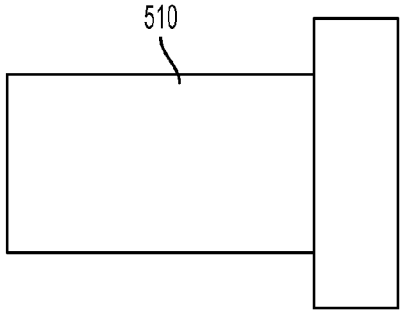
FIG. 19 shows a side view of an exemplary embodiment of a weight bar hook pin according to the present invention.
Figure 20:
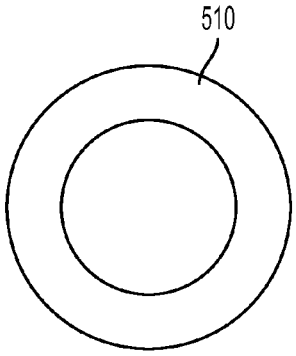
FIG. 20 shows a bottom view of an exemplary embodiment of a weight bar hook pin according to the present invention.

Referring next to FIG. 12 and to FIG. 13, there is shown a top view of weight support 400 and a side view of weight support 400, respectively. As illustrated in FIGS. 12 and 13, weight support 400 further comprises a partially capturable pin 420, as shown in FIG. 12*a*, which presents a front view of vertical weight support 400 and pin 420.

Returning again to FIG. 2, in the preferred embodiment of the invention, a pair of weight supports 400 are attached to cross member 200 by laying the curved ends of each weight support 400 over cross member 200 and dropping captured pins 420 through corresponding holes through cross member 200.

FIGS. 14-20, show several views are presented of weight bar hook 500 and pins 510. As further illustrated in FIGS. 1, 2, and 3, weight bar hooks 500 are attached via pins 510 placed through teardrop holes 410 of weight support arms 400. In function, apparatus 1000 is operated by releasably attaching apparatus 1000 to a weight rack (not shown) of common design. Referring again to FIGS. 1, 2, and 3, when lever arm 300 is engaged with cross member 200, as lever arm 300 is rotated cross member 200 also rotates. A common weight bar (not shown), having a desired amount of plate like weights on either side, is placed on weight bar hooks 500 when supports 400 are in the lowered position illustrated in FIG. 2.

The above-described embodiments are merely exemplary illustrations set forth for a clear understanding of the principles of the invention. Many variations, combinations, modifications, or equivalents may be substituted for elements thereof without departing from the scope of the invention. It should be understood, therefore, that the above description is of an exemplary embodiment of the invention and included for illustrative purposes only. The description of the exemplary embodiment is not meant to be limiting of the invention. A person of ordinary skill in the field of the invention or the relevant technical art will understand that variations of the invention are included within the scope of the claims.

The invention claimed is:

1. A weightlifting weight support apparatus, said apparatus comprising:

a weight rack comprising a pair of vertical upright beams, each of said beams comprising a plurality of bores disposed vertically along a front of said beams; an elongated cross member, said cross member comprising a pair of opposing ends; a lever arm selectively rotatably attached to at least one of said ends; a pair of vertical weight supports fixedly attached to said cross member, each of said weight supports comprising a longitudinal axis and a plurality of bores disposed vertically along said longitudinal axis; at least one weight bar receiver, each of said weight bar receivers comprising at least one protrusion for selectively engaging said bores of said vertical weight supports; and a first and a second cross member support subassembly, each of said cross member support subassemblies selectively attached to the front of said beams, each of said cross member support subassemblies comprising a proximal end, said proximal end of said cross member support subassemblies comprising a cross member receiving groove having an opening, a slot, and a trough, wherein said cross member is slidingly and rotatably engaged with said cross member receiving groove; and each of said cross member support subassemblies comprising a distal end, said distal end of each of said cross member support subassemblies comprising a vertical plate, a pin extending perpendicularly from said plate, and at least one horizontal hook extending from said plate, said distal end of each said cross member support subassembly removably connectable to said rack via an engagement of said pin in said bores of said vertical upright beams and said horizontal hook around said vertical upright beams of said rack.

* * * * *